US005380123A

United States Patent [19]

Ryynänen

[11] Patent Number: 5,380,123

[45] Date of Patent: Jan. 10, 1995

[54] METHOD FOR BUILDING A ROAD BED AND THE USE OF THE SAME

[75] Inventor: Seppo Ryynänen, Kouvola, Finland

[73] Assignee: Gesertek Oy, Kouvola, Finland

[21] Appl. No.: 235,183

[22] Filed: Apr. 29, 1994

Related U.S. Application Data

[63] Continuation of Ser. No. 39,102, Apr. 8, 1994.

[30] Foreign Application Priority Data

Oct. 9, 1990 [FI] Finland ..... 904959

[51] Int. Cl.[6] ..... E01D 7/00; E04B 1/32

[52] U.S. Cl. ..... 404/82; 14/24; 264/309; 405/182

[58] Field of Search ..... 405/124; 264/309; 14/24; 404/82

[56] References Cited

U.S. PATENT DOCUMENTS

| | | | |
|---|---|---|---|
| 597,590 | 1/1898 | Pratt | 14/24 |
| 1,864,598 | 6/1932 | Kessler . | |
| 2,315,895 | 4/1943 | Crom | 264/309 X |
| 2,425,079 | 8/1947 | Billig | 72/50 |
| 2,686,421 | 8/1954 | Barron | 14/24 X |
| 2,964,821 | 12/1960 | Meehan | 264/34 |
| 3,622,656 | 11/1971 | Dewey et al. | 264/309 X |
| 3,751,929 | 8/1973 | Bernold | 61/42 |
| 3,776,990 | 12/1974 | Watkins, Jr. et al. | 264/309 X |
| 4,155,967 | 5/1979 | South et al. | 264/309 X |
| 4,211,504 | 8/1980 | Sivachenko | 405/124 X |
| 4,587,684 | 5/1986 | Miller | 14/24 |
| 4,597,925 | 7/1986 | Loggy | 52/742 X |
| 4,618,283 | 10/1986 | Hilfiker | 405/124 |
| 4,695,187 | 9/1987 | Mikhailovsky et al. | 405/124 |
| 4,890,993 | 1/1990 | Wilson | 52/88 X |

FOREIGN PATENT DOCUMENTS

| | | | |
|---|---|---|---|
| 29705 | 10/1958 | Finland . | |
| 1286805 | 1/1962 | France | 14/24 |
| 0246581 | 6/1987 | German Dem. Rep. | 14/77.1 |
| 1931431 | 12/1970 | Germany . | |
| 0100208 | 4/1991 | Japan | 14/24 |
| 100074 | 6/1962 | Norway . | |
| 155822 | 2/1987 | Norway . | |
| 303307 | 8/1968 | Sweden . | |
| 447280 | 11/1986 | Sweden . | |
| 456685 | 10/1988 | Sweden . | |
| 620272 | 11/1980 | Switzerland . | |

*Primary Examiner*—Ramon S. Britts
*Assistant Examiner*—James A. Lisehora
*Attorney, Agent, or Firm*—Ostrolenk, Faber, Gerb & Soffen

[57] ABSTRACT

A method for building a road bed by providing a plurality of vaulted structures located at a road bed site. A first layer of concrete is applied on the structures for reinforcing the structures. The structures can be comprised of a profiled steel plate or a sheet metal mesh. They may have reinforcement braces comprised of troughs or corrugations provided on an outer surface of the structures which receive the first layer of concrete. The first layer of concrete is allowed to set before a second layer of concrete is applied to the structures and to the first layer to form a concrete casing.

17 Claims, 15 Drawing Sheets

METHOD FOR BUILDING A ROAD BED AND THE USE OF THE SAME

This is a continuation of application Ser. No. 08/039,102, filed on Apr. 8, 1994.

BACKGROUND OF THE INVENTION

1. Field of the Invention

The present invention relates to a method for building a road bed.

2. Description of the Related Art

Our earlier Patent application FI 894535 discloses a method for producing a joint structure formed of a combination of a shaped plate, generally a profiled steel plate, and concrete shotcreted on the shaped plate. An expanded sheet metal mesh manufactured thin steel sheet by elongation, is known from U.S. Pat. No. 1,864,598 and 3,034,197. A widermeshed diagonal screen grid manufactured from thicker sheet metal by cutting and elongation is known from U.S. Pat. No. 3,570,086.

A drawback in the current road-building methods is that a road bed requires the soil masses, which often leads to undesired the depressions in the soft ground underneath. The elimination of the depressions requires expensive ground reinforcements. Indeed, the construction of road beds on soft basic ground generally incurs major expense and extra costs.

Building passages in road-bed structures by the application of the prior known methods is expensive and inconvenient. Particularly, the casting of concrete into an arched vaulted shape is difficult and tedious. Carrying great masses of soil to a road-construction site requires a lot of time and causes environmental problems. The soil materials suitable for road-building are nearly exhausted in many places and must often be excavated in areas valuable in terms of environmental protection. Construction on soft grounds may take several years, as the reinforcement of subsoil is a tedious procedure. The road surfaces do not often remain flat, but develop traffic-disturbing depressions.

At present, road beds used as soil storages are useless especially in urban areas, for example where, the street sections are highly valuable areas. These road beds should be in service for more useful priorities other than the storage of sand.

SUMMARY OF THE INVENTION

An object of the present invention is to alleviate the above drawbacks by means of a method of applying shotcreting to provide a road bed having one or a plurality of vaulted cavities inside a concrete casing.

The invention can be used for a great number of applications.

In the specification, the term "roadway" refers to highways, walking paths, railroads, and streets, as well as like passages.

The term "vaulted" refers in specification to arched vaults, vaulted shapes consisting of arched and straight sections, circles, egg shapes and its sections, as well as parabolic and hyperbolic segments. A vaulted structure is often dominated by compression stresses, but also flexural stresses may exist. Compression stresses are preferred since in that case the concrete does not require many steel reinforcements to take up tensile stresses. Thus, the structure will be inexpensive as expensive steel can be saved.

DETAILED DESCRIPTION OF THE PREFERRED EMBODIMENTS

Figure 1:
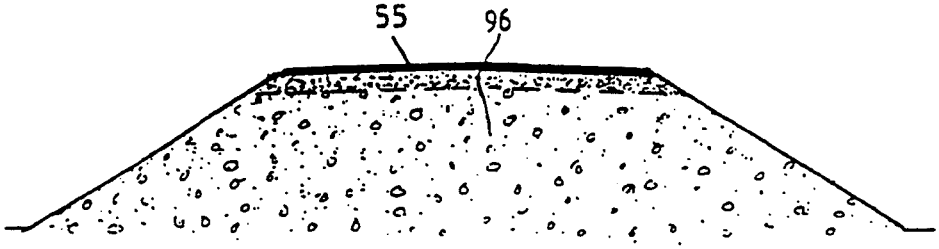
FIG. 1 shows in cross-section a presently used general road bed.
Figure 2:
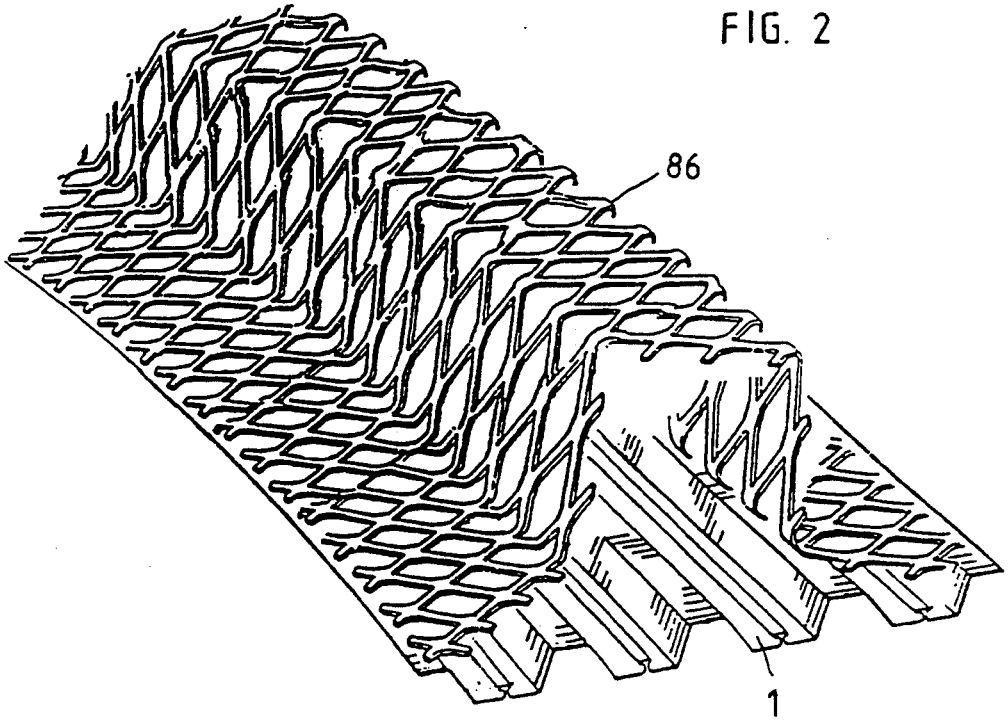
PRIOR ART FIG. 2
FIG. 2 shows an arched bent mesh and plate section prior to concreting.

FIG, 1 Illustrates a known available road structure having a great amount of soil material underneath a cover structure 55. The resulting road bed is heavy and requires large amounts of soil material;

In FIG. 2, an arched mesh 86 has been mounted on top of an arched and profiled thin sheet 1. Mesh 86 is shaped into an apexed form for increased rigidity. The diagonal strands of mesh 86 provide dimensional stability prior to concreting.

Figure 3:
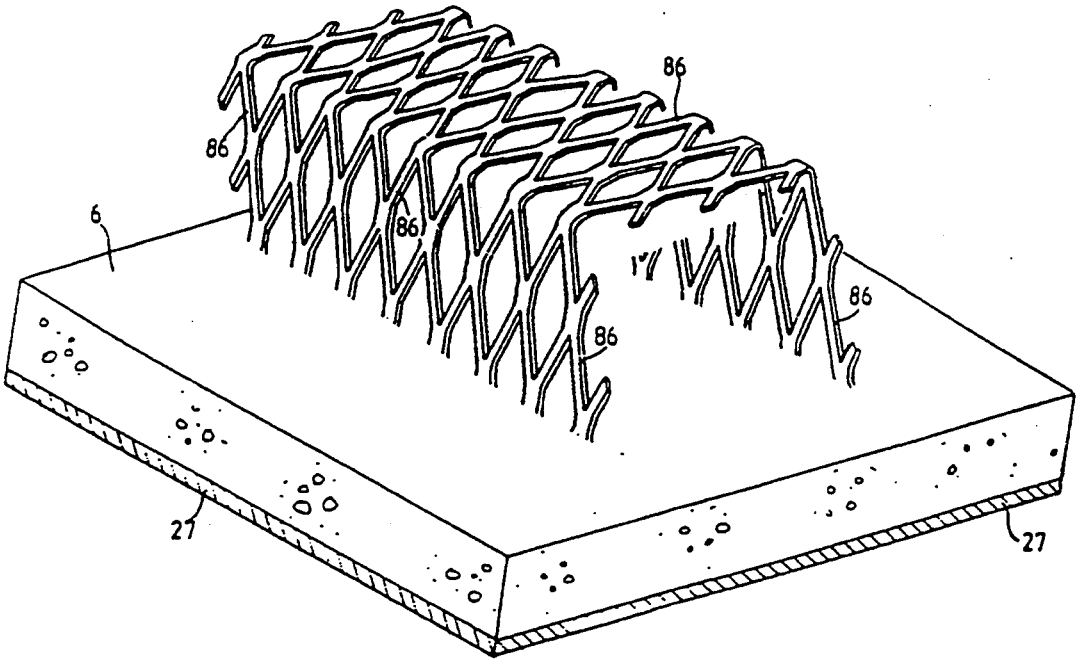
FIG. 3 shows a section of an elongated mesh structure following the addition of a first concrete layer.

In FIG. 3, a first shotcrete layer 6 is applied to cover the lower section of mesh 86 and sheet 1. In order to prevent the passage of shotcrete, it is possible to employ some sort of a backing member 27, temporarily or permanently. Through mesh apertures the concrete mass 6 works its way inside the ribbed mesh portion.

Figure 4:
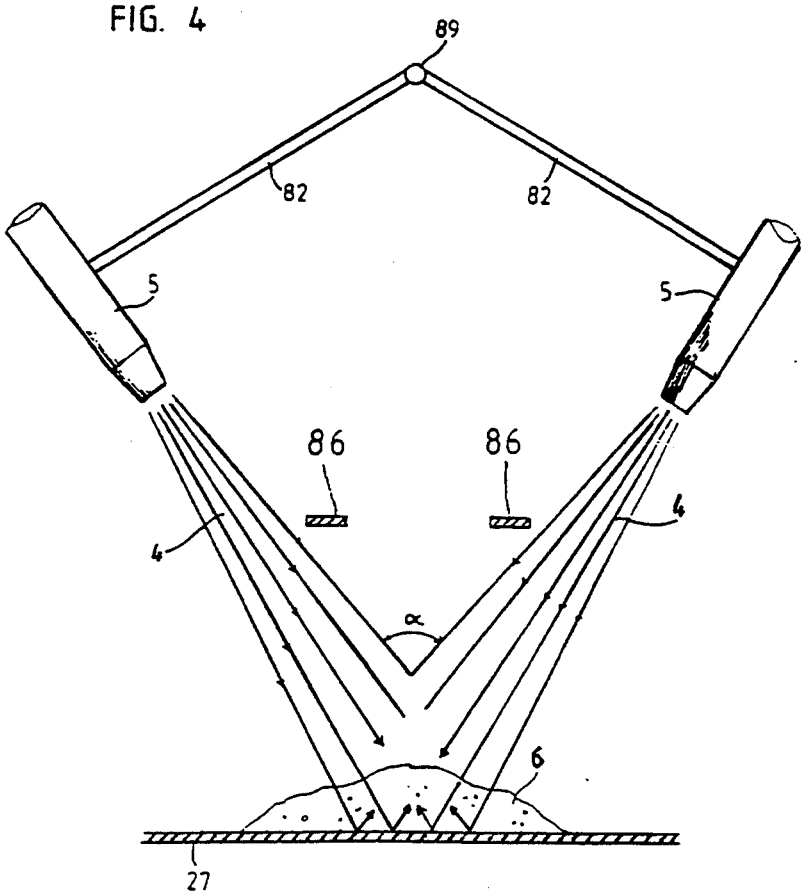
FIG. 4 illustrates shotcreting by means of two nozzles behind steel members.

A double nozzle 5 as shown in FIG. 4 can be used for spraying shotcrete 4 on the same spot from different directions, for filling possible shadow regions caused by steel members 86. It is also possible to employ a plurality of nozzles to spray concrete from different directions to a common spot. Nozzles 5 can be secured to support arms 82 that can be linked with a pivot 89 for adjusting the angle of incidence between various nozzles 5. If desired, the concrete mass 4 can be ricocheted from backing member 27 into Spaces behind steel members 86.

Figure 5:
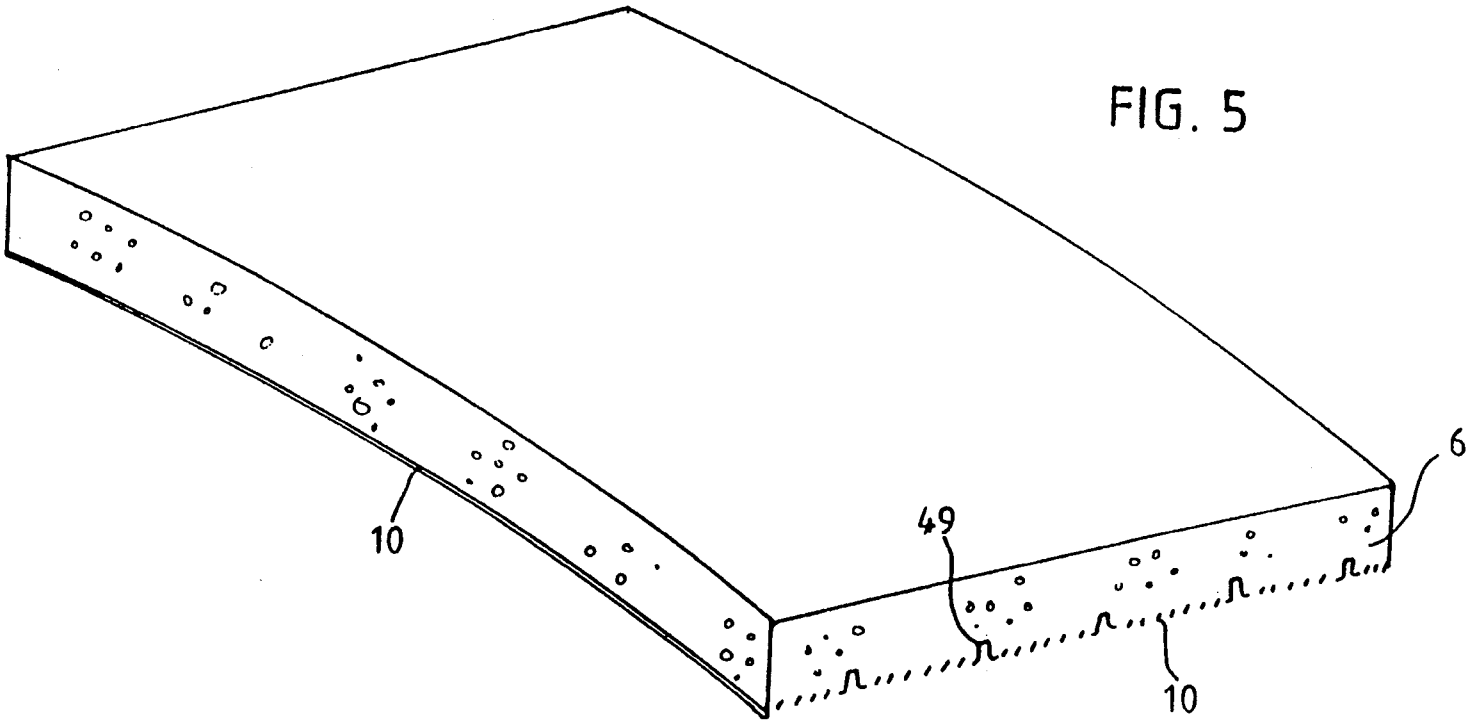
FIG. 5 shows a concrete casing sprayed on top of an expanded sheet metal mesh braced with reinforcement corrugations.

In FIG. 5, the shotcreting is effected on top of an expanded sheet metal mesh 10 reinforced with corrugations 49.

Figure 6:
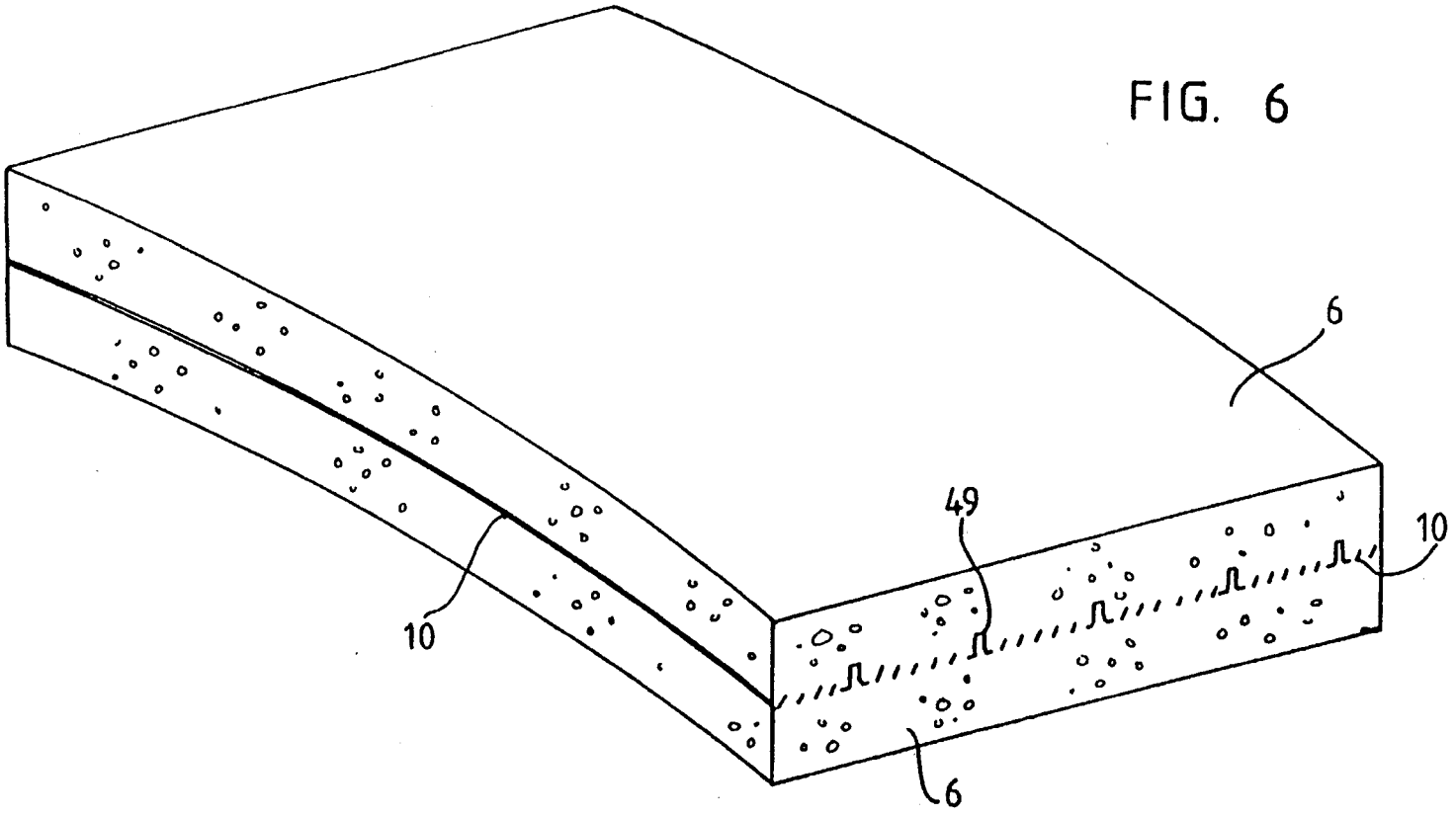
FIG. 6 shows an expanded sheet metal mesh shotcreted on both sides.

In an embodiment shown in FIG. 6, an expanded sheet metal mesh 10 is shotcreted on both sides, to increase the vault strength with increased thickness. At the same time, a mesh made of, e.g. steel, can the protected against corrosion.

Figure 7:
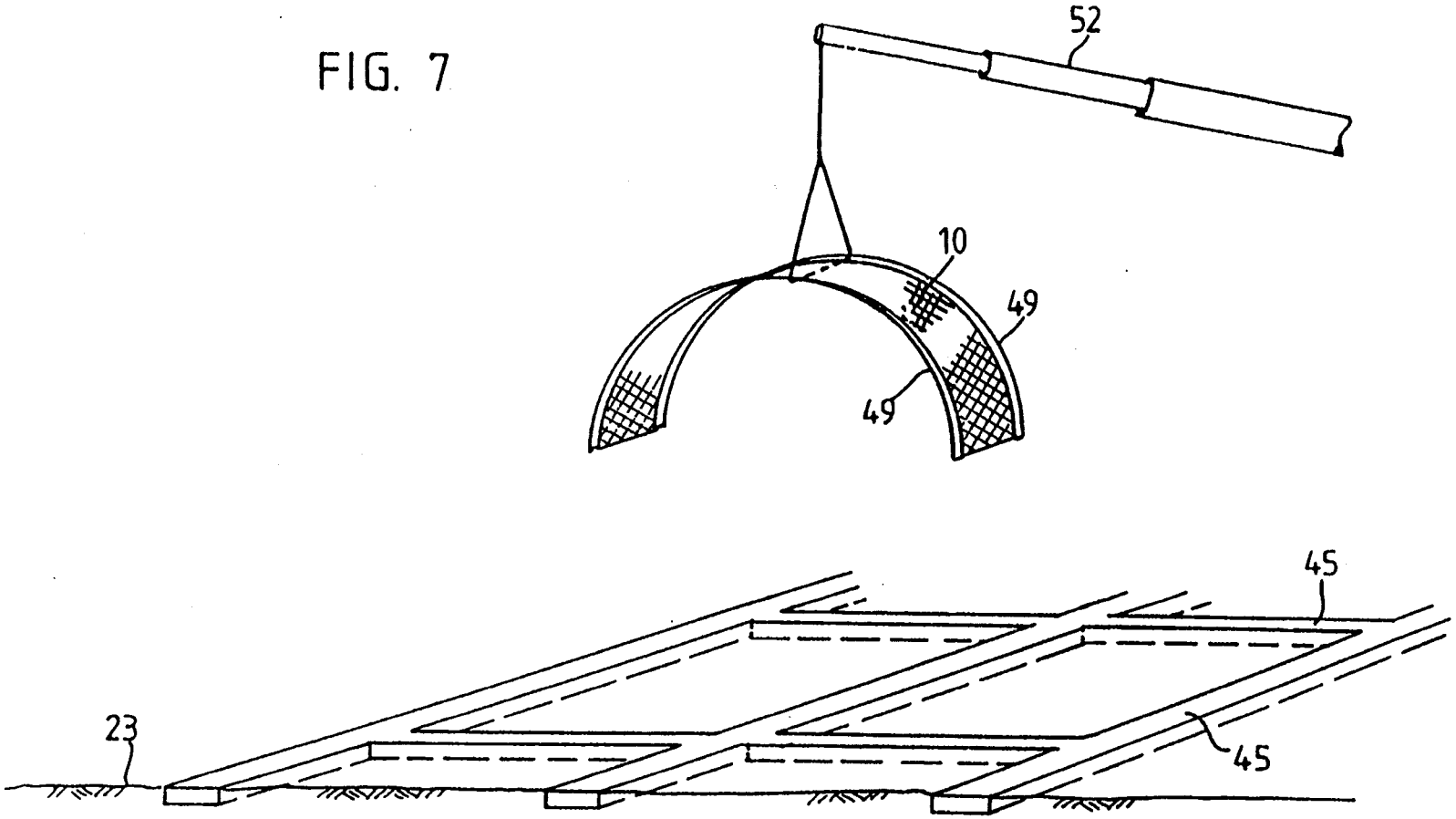
FIG. 7 illustrates the lifting of a prevaulted shotcreted surface element on top of a foundation.

In FIG. 7, a crane 52 is used for lifting a vaulted mesh element 10 on top of pre-made foundations 45, the element 10 being provided with reinforcement corrugations 49. The mutually tied foundations 45 are preset on ground 23.

Figure 8:
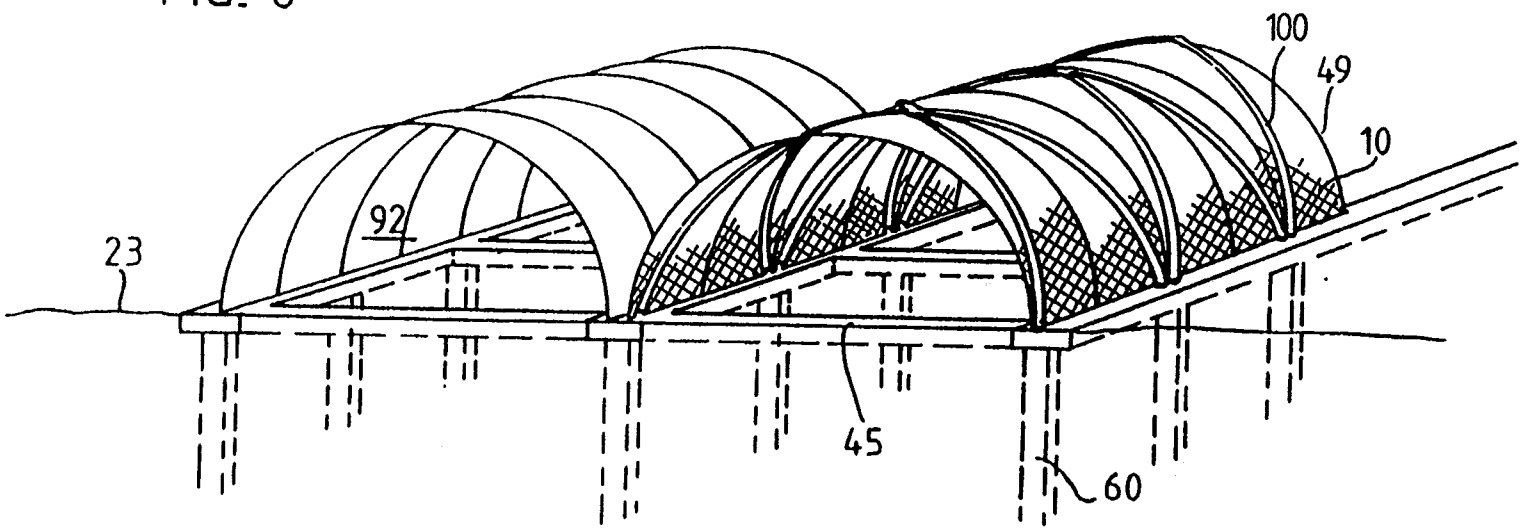
FIG. 8 illustrates two parallel-set vaulted concreting surfaces.

In FIG. 8, the mesh elements are provided with reinforcement braces 100 which can be e.g. mesh troughs. Those can be first shotcreted full of concrete at the beginning of a concreting operation, when the structure is still light. The structurally reinforcing braces are developed upon setting of the concrete. The diagonal reinforcement braces 100 are used to readily transfer the loads on a vault to piles 60 on soft ground.

Figure 9:
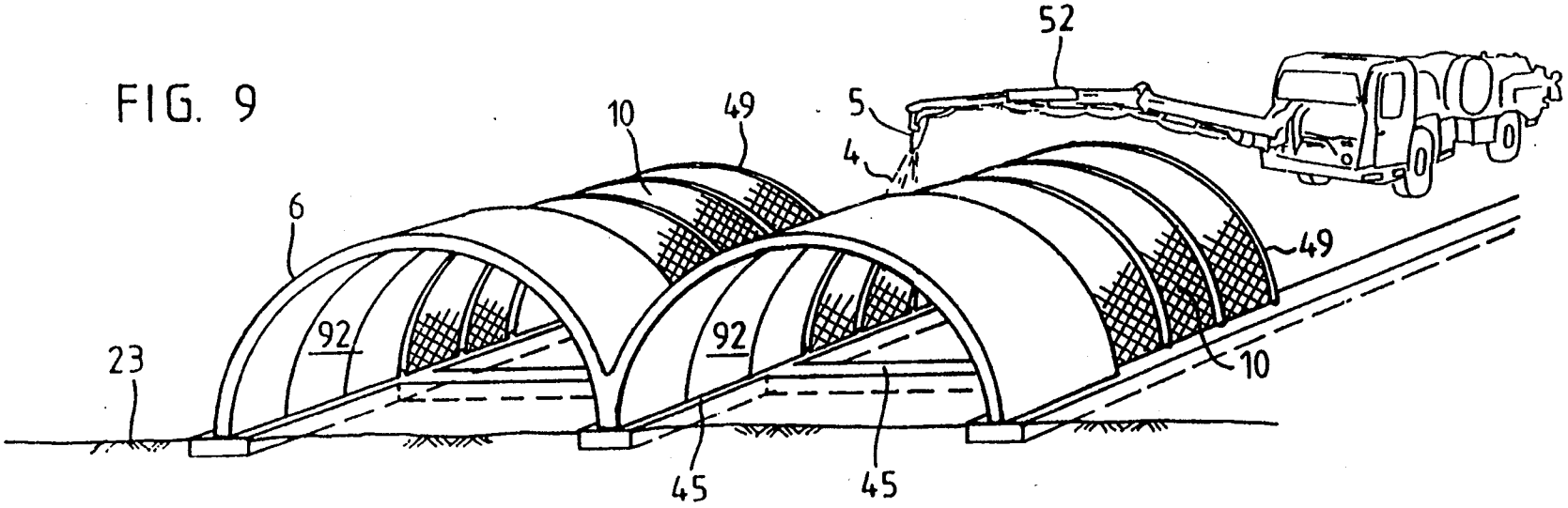
FIG. 9 illustrates shotcreting mesh elements by means of a remote-controlled heavyduty machine.

In FIG. 9, shotcreting is carried out effectively from a remote-control equipped machine and having crane 52 nozzles onto parallel mesh elements 10 forming vaulted cavities 92. Concreting can be effected in layers in a manner that structural strength increases gradually as the preceding concrete layers are setting. The weight and strength of the structure are increased at the same rate.

Figure 10:
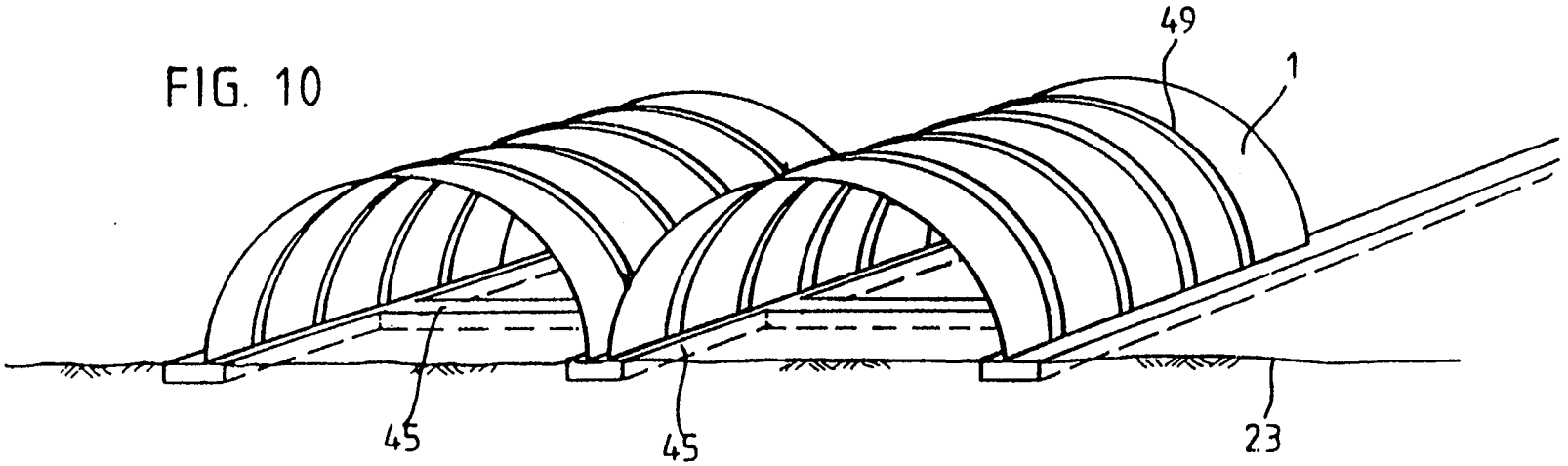
FIG. 10 illustrates vaulted and profiled thin sheets on top of a foundation prior to concreting.

In an embodiment shown in FIG. 10, shotcreting can be applied onto a profiled metal sheet 1.

Figure 11:
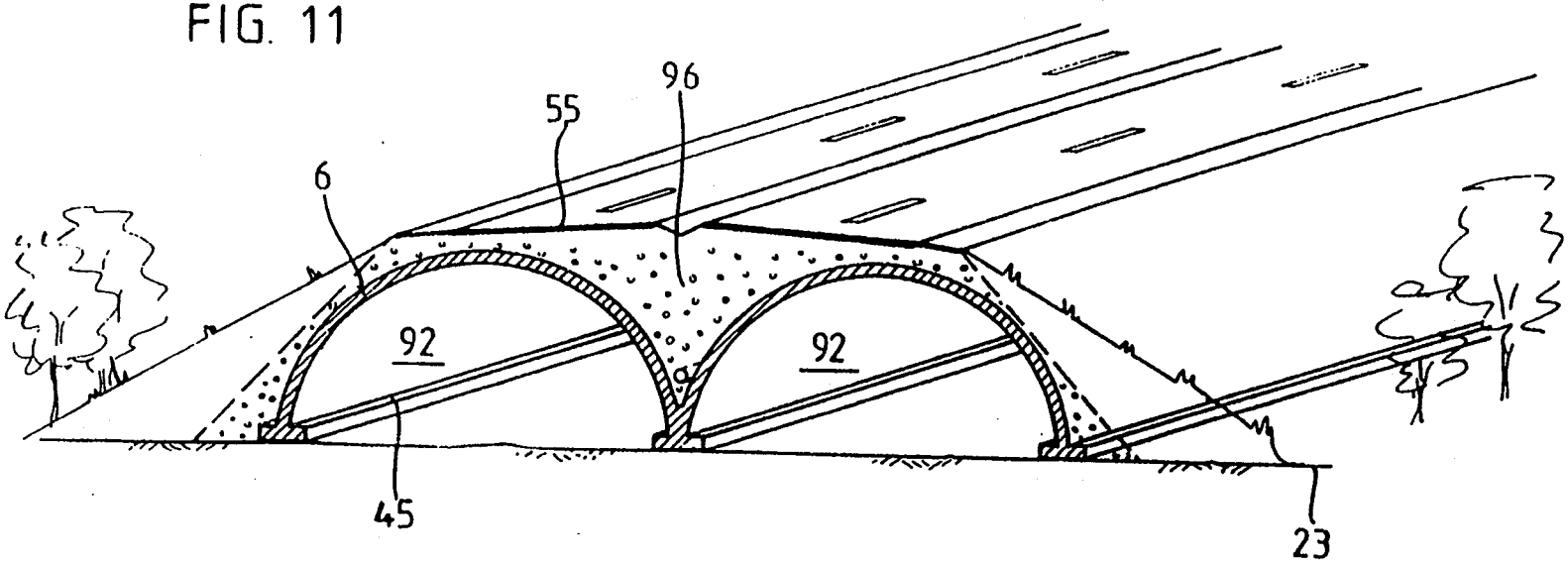
FIG. 11 shows a finished road structure obtained according to the invention.

In an embodiment shown in FIG. 11, a road construction 96 is provided by shotcreting two vaulted cavities 92 extending side by side. The horizontal stresses of concrete casings 6 on the level of foundations can be directed oppositely to each other at the center.

Figure 12:
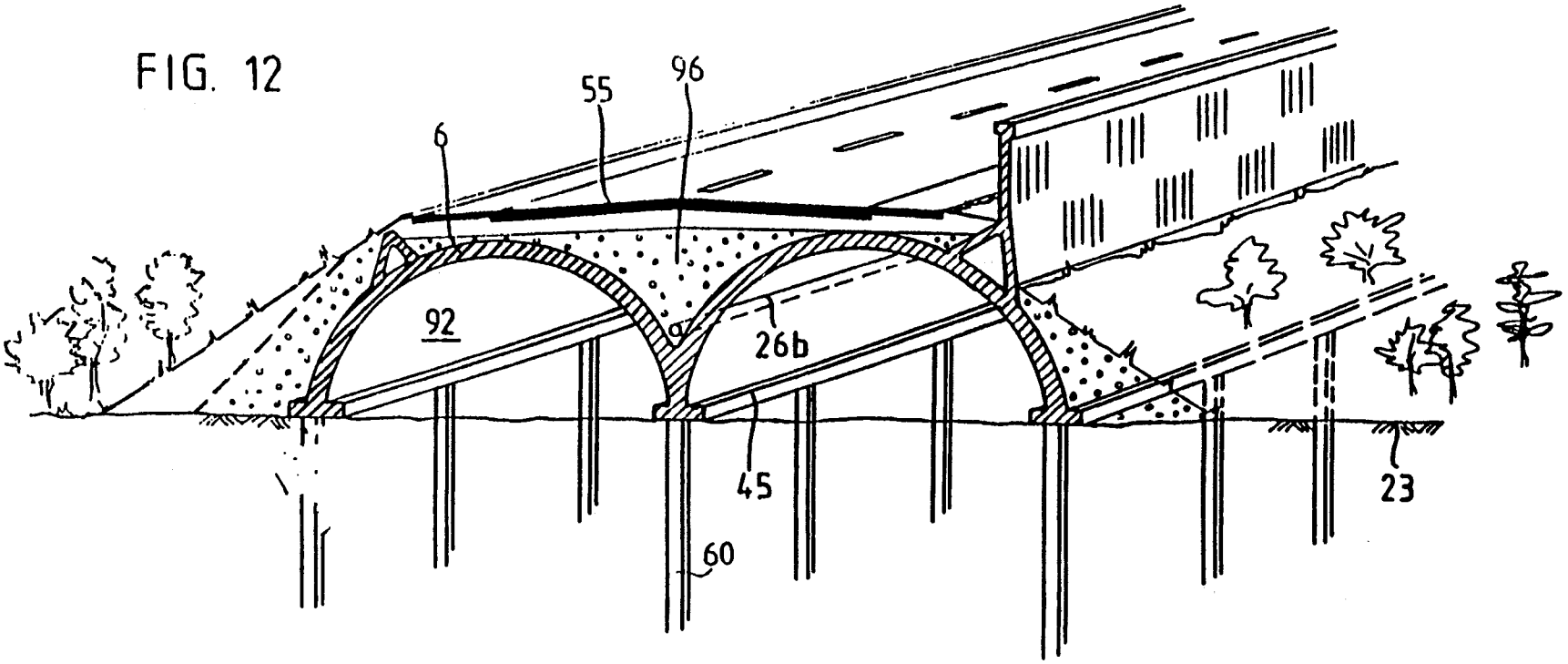
FIG. 12 shows a finished road structure built on top of piles.

In an embodiment shown in FIG. 12, shotcreting is used to provide a vaulted casing structure 6 with a noise barrier and upper-structure supporting ribs for supporting roadway 55 and pipeline **26*b***.

Figure 13:
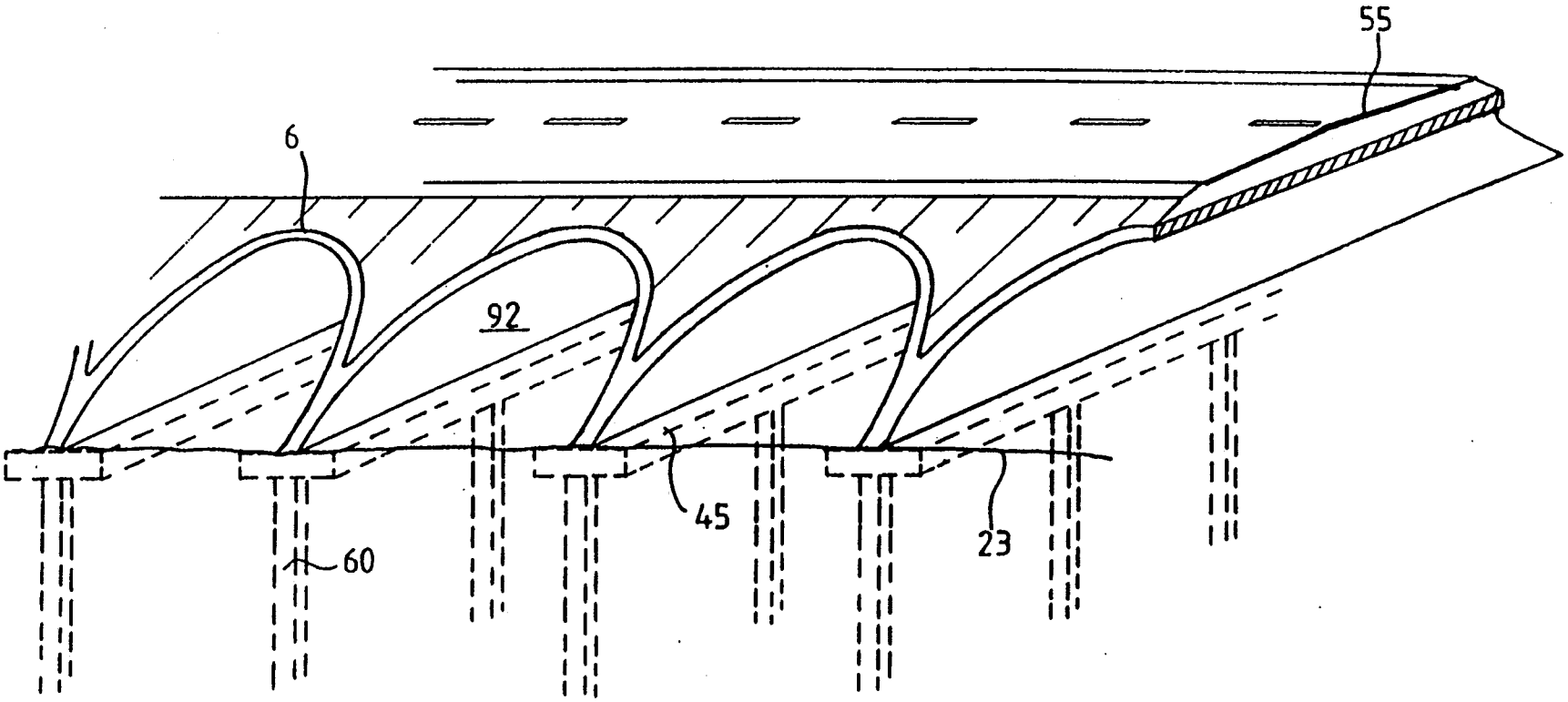
FIG. 13 shows a visualization of an alternative road structure with passages extending crosswise relative to the direction of a road.
Figure 14:
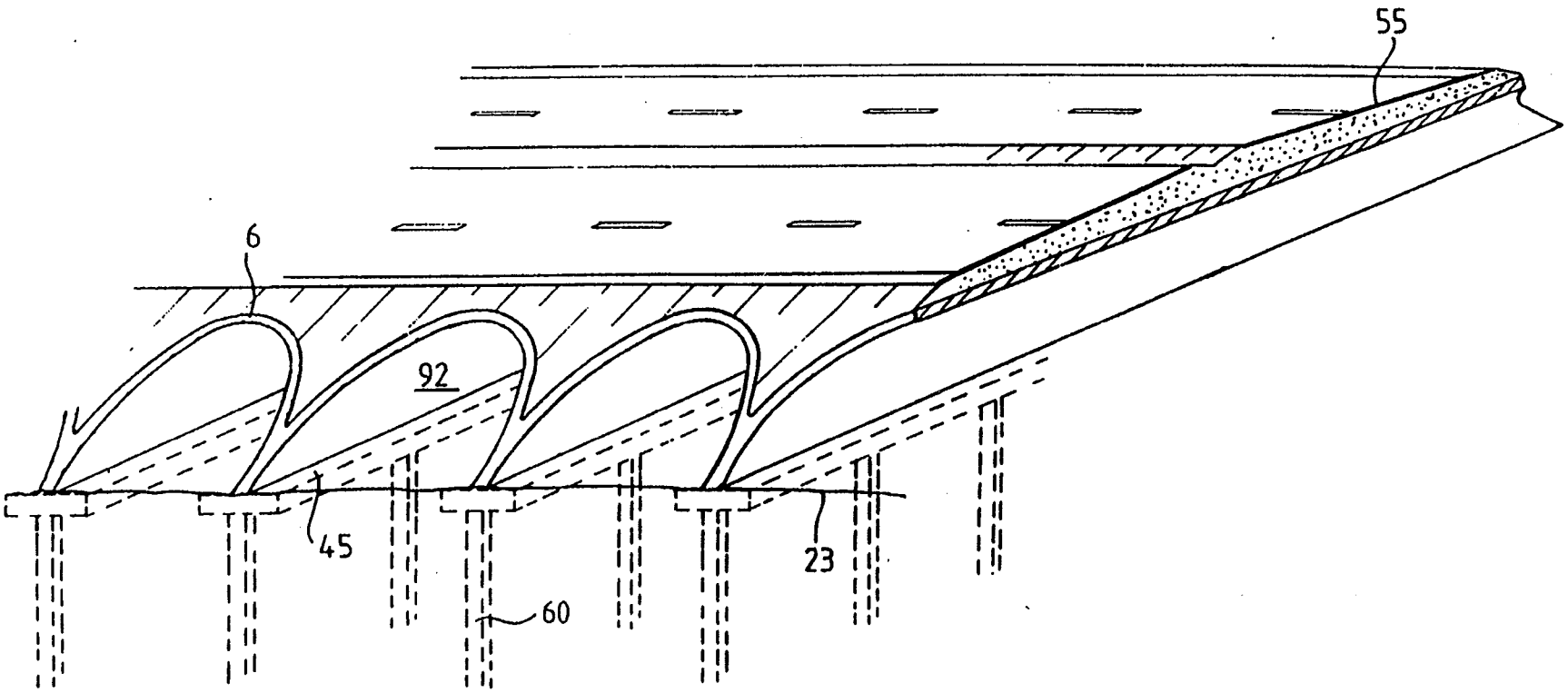
FIG. 14 shows a divided roadway located on top of piles.

In an embodiment shown in FIGS. 13 and 14, cavities or passages 92 are placed side by side and thus, on the level of foundations, the horizontal forces substantially neutralize each other. The passages extend crosswise to a roadway and can serve as underpasses, bridges, or storage cavities for example.

Figure 15:
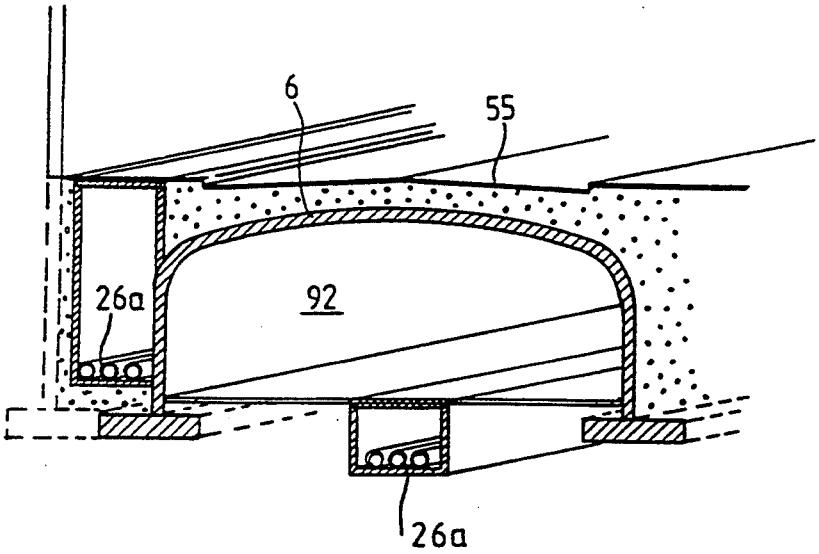
FIG. 15 shows a street obtained according to the invention.
Figure 16:
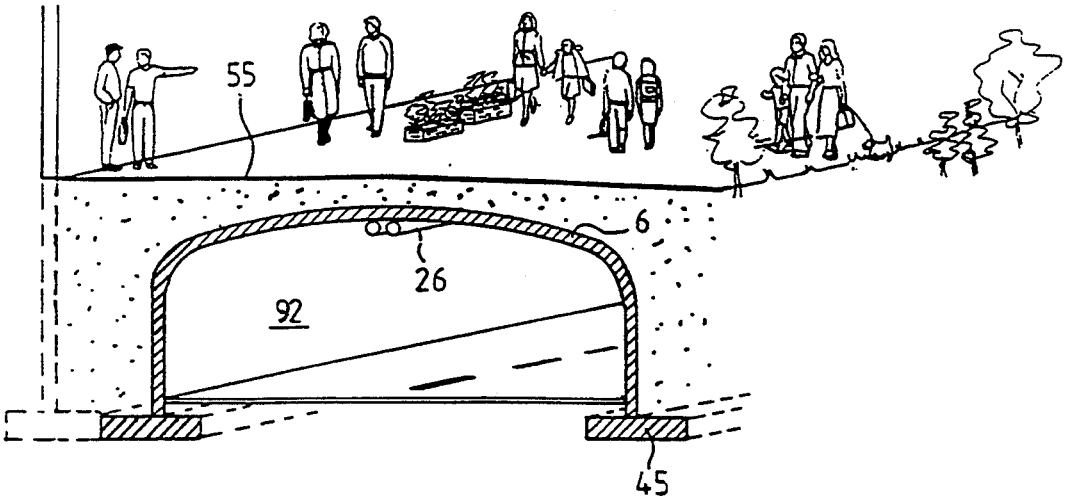
FIG. 16 shows a pedestrian street obtained according to the invention.

In FIGS. 15 and 16, vault cavity 92 is provided underneath a street area 55 e.g. for traffic, pipelines 26, **26*a*** or other equipment.

Figure 18:
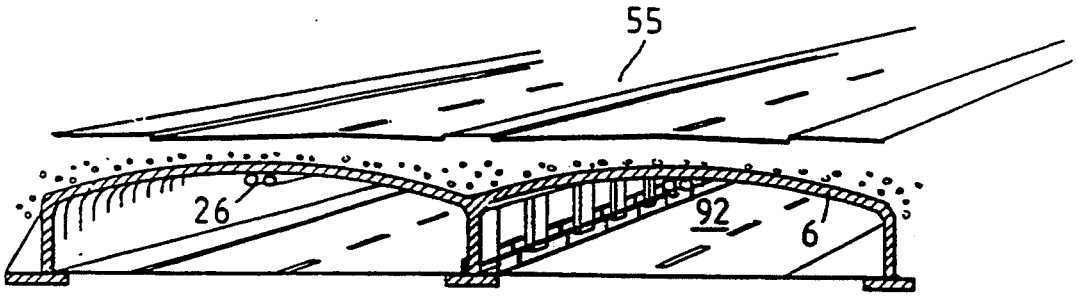
FIG. 18 shows a roadway with another traffic route provided in its bed structure.
Figure 17:
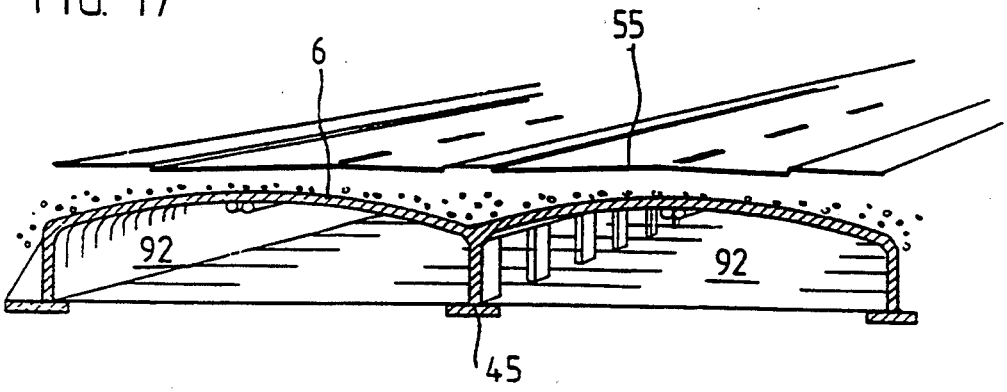
FIG. 17 shows a roadway obtained according to the invention with a parking lot provided in its bed structure.

In FIGS. 17 and 18, the road bed is also adapted to the requirements of traffic in crowded urban areas with no available space for large parking lots or multi-lane roadways.

Figure 19:
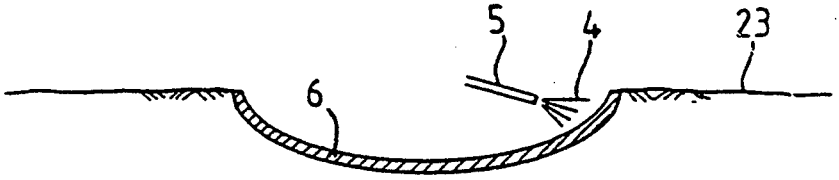
FIG. 19 shows in cross-section shotcreting the ground having an egg shape.
Figure 20:
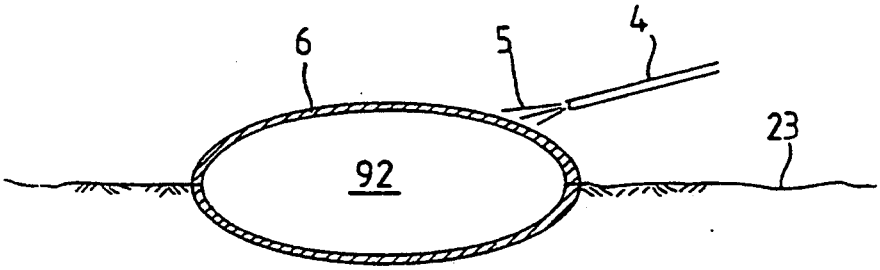
FIG. 20 shows the spraying of the top portion of an egg-shaped cross-section on top of the structure shown in FIG. 19.
Figure 21:
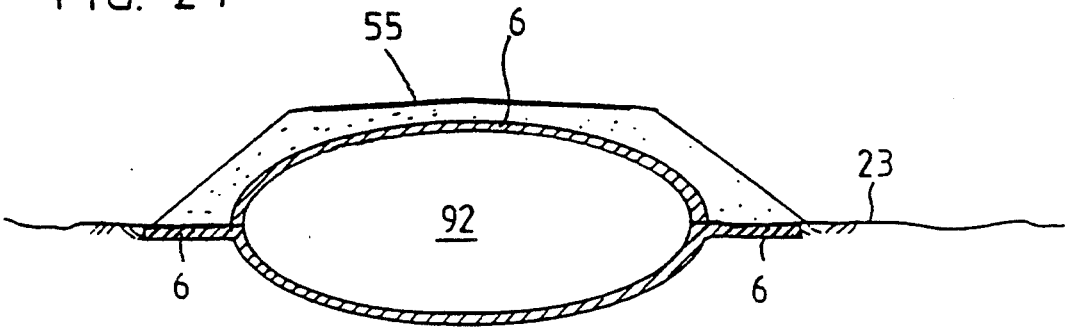
FIG. 21 shows a cross-section of a road structure set on top of an egg-shaped void.

In FIGS. 19, 20 and 21, an egg-shaped void space 92 is formed in the bed of a road 55. The egg-shaped form is preferable in terms of stresses. At the beginning, concreting can be effected against the ground 23. The necessary mesh or plate elements are used as a shotcreting foundation for the top section. Necessary extensions can also be readily made by shotcreting. If desired, it is also possible to employ a circular form or some other shape instead of an egg shape in cavity 92.

An essential object of this invention is to make a hollow road bed as light as possible with minimum labor. A method of the invention can be applied to produce structures having a great load-carrying capacity and flexural strength.

I claim:

1. A method of building a road bed comprising the steps of:

(a) placing at least one hollow vaulted structure at a site wherein the vaulted structure includes a plurality of individual concrete-holding reinforcement braces which extend over the vaulted structure;

(b) shotcreting concrete on each one of the plurality of reinforcement braces of the vaulted structure and allowing the concrete to set to define a plurality of separate concrete-filled reinforcement braces to reinforce the vaulted structure;

(c) with the vaulted structure at a road bed site, applying a layer of concrete over the vaulted structure to form a road bed.

2. The method of claim 1, wherein the concrete layer is applied by shotcreting.

3. The method of claim 2, wherein the vaulted structure is formed from a mesh and the first layer of concrete is applied on the mesh.

4. The method of claim 3, wherein the mesh is of sheet metal.

5. The method of claim 3, further comprising the step of placing a concrete backing on an undersurface of the mesh.

6. The method of claim 1, comprising placing a plurality of the vaulted structures at the site; shotcreting concrete over all of the reinforcement braces of the vaulted structures to define a plurality of concrete-filled reinforcement braces; and applying the concrete layer over all of the vaulted structures and their concrete-filled reinforcement braces.

7. The method of claim 6, wherein the concrete layer is applied by shotcreting.

8. The method of claim 6, wherein the vaulted structures are placed side by side extending along the length of road bed before the concrete layers are applied.

9. The method of claim 8, wherein the plurality of vaulted structures are placed side by side such that horizontal stresses of adjacent vaulted structures oppose each other.

10. The method of claim 1, wherein the braces are concrete receiving troughs on the vaulted structure.

11. The method of claim 1, wherein the vaulted structure is a mesh layer and the braces are mesh, concrete receiving troughs on the vaulted structure.

12. The method of claim 1, wherein the reinforcement braces comprise troughs and the troughs are filled with concrete before the layer of concrete is applied.

13. The method of claim 1, wherein the reinforcement braces comprise corrugations in the vaulted structure and the concrete is shotcreted on the corrugations before the layer of concrete is applied to the vaulted structure.

14. The method of claim 1, wherein the reinforcement braces comprise trussed bracing.

15. The method of claim 1, wherein the vaulted structure is formed from a mesh and the first layer of concrete is applied on the mesh.

16. The method of claim 1, wherein the first concrete layer is applied on both a top and bottom surface of the vaulted structure.

17. A method of building a road bed, comprising the steps of (a) placing a support in a vaulted structure form at a road bed site, wherein the vaulted structure includes a plurality of individual concrete-holding reinforcement braces which extend over the vaulted structure;

(b) shotcreting concrete onto each one of the plurality of reinforcement braces to define a plurality of separate concrete-filled reinforcement braces over the vaulted structure form and integral therewith;

(c) allowing the shotcreted concrete to set in the braces;

(d) continuing the shotcreting so as to form a concrete casing in the vaulted structure form.

* * * * *